US005833306A

United States Patent [19]

Breto

[11] Patent Number: 5,833,306

[45] Date of Patent: Nov. 10, 1998

[54] CHAIR ASSEMBLY TRANSFORMABLE INTO A TABLE, A BAR AND AN IRONING TABLE

[76] Inventor: Matilde Barbed Breto, Plaza San Francisco, 17-70 Ctro. E-50006, E-50006 Saragossa, Spain

[21] Appl. No.: 750,031

[22] PCT Filed: Mar. 20, 1996

[86] PCT No.: PCT/ES96/00058

§ 371 Date: Nov. 25, 1996

§ 102(e) Date: Nov. 25, 1996

[87] PCT Pub. No.: WO96/29915

PCT Pub. Date: Oct. 3, 1996

[30] Foreign Application Priority Data

Mar. 24, 1995 [ES] Spain ..... 9500596
Jun. 26, 1995 [ES] Spain ..... 9501280

[51] Int. Cl.[6] ..... A47B 85/04

[52] U.S. Cl. ..... 297/124; 297/125; 297/188.1

[58] Field of Search ..... 297/124, 125, 297/188.1, 188.09; 403/164, 165, 119; 299/248

[56] References Cited

U.S. PATENT DOCUMENTS 365,344 6/1887 Lawrence et al. ..... 297/125
1,468,817 9/1923 Jones ..... 297/125
1,703,981 3/1929 Armstrong et al. ..... 297/125
1,773,791 8/1930 Rohrmann ..... 297/125
1,937,886 12/1933 Grose ..... 297/124
2,691,405 10/1954 Hinch ..... 297/125
2,814,334 11/1957 Lane ..... 297/125

FOREIGN PATENT DOCUMENTS 6836 of 1902 United Kingdom ..... 403/119

*Primary Examiner*—Peter M. Cuomo
*Assistant Examiner*—Anthony D. Barfield
*Attorney, Agent, or Firm*—Hoffmann & Baron, LLP

[57] ABSTRACT

A convertible chair having a board (2, 36) inside the frame of a chair or arm-chair to which the seat (0, 35) has been previously removed. This arrangement provides that the seat (0, 35) will act as a support for the board (2, 36) when the latter is used as an ironing table or a bar table. To this effect, a frame is deployed so that the board (2, 36) passes from the back or vertical position to the horizontal or table position , Additionally, the panel of the seat (0, 35) moves from the horizontal position to the vertical position as a support for the board (2, 36) when the latter is in the table position. In the version of the seat assembly transformable into a table and bar, the latter is incorporated into the seat body. The invention finds application in household furniture, fair stands and commercial shows.

15 Claims, 15 Drawing Sheets

CHAIR ASSEMBLY TRANSFORMABLE INTO A TABLE, A BAR AND AN IRONING TABLE

FIELD OF THE INVENTION

The present invention refers to a new prototype made up of a chair or lounge chair that may be converted into a table and bar for use in homes, apartment-hotels, booths at fairs and commercial expositions, and offices.

SUMMARY OF THE INVENTION

It is an object of the present invention to provide a convertible chair which reduces the need for space.

It is still a further object of the invention to provide a convertible chair including a chair frame having a pair of spaced front legs having an upper portion; a pair of spaced rear legs opposed from the front legs; a pair of upwardly extending members each having a distal end projecting from the pair of rear legs; and a plurality of connecting members rigidly securing the pair of front and rear legs to the chair. A backrest is provided which is pivotally securable to the frame between the upwardly extending members. The backrest is rotatable from a generally vertical orientation to a substantially horizontal orientation forming a table surface. A panel forming a seat having a front end, and having a substantially horizontal orientation forming a sitting surface is further provided. The seat is pivotally securable to the frame adjacent the pair of front legs by at least one first pivot device. The at least one first pivot device includes a rigid L-shaped member having a first leg and a second leg. The first leg is rotatably secured to the frame about a first center of rotation and the second leg spaces the seat a distance from the frame and is rigidly attached to a bottom surface of the seat. The seat is rotatable to a substantially vertical orientation and selectively engageable with the horizontally orientated backrest, thereby forming a support for the backrest in the horizontal orientation.

Furthermore, with the same quality, it may be more favorable economically. It is a further object of the invention to provide a convertible chair comprising, a chair frame. The frame including a pair of spaced front legs having an upper portion, a pair of spaced rear legs opposed from the front legs, and a pair of upwardly extending members projecting from the pair of rear legs each having a distal end. The pair of front and rear legs being rigidly secured to the frame and fixed with respect thereto. A backrest is provided, having an upper and lower end, and is pivotally securable to the frame between the upwardly extending members. The backrest is rotatable from a generally vertical orientation to a substantially horizontal orientation forming a table surface. The chair of the present invention further includes a seat having a front end. The seat is pivotally securable to the frame and has a substantially horizontal orientation forming a sitting surface. The seat is rotatable to a substantially vertical orientation engageable with the horizontally orientated backrest, thereby forming a support for the backrest in the horizontal orientation than when bought separately.

The idea for this set derives from that of providing an ironing board inside the frame of a chair from which the seat has been previously removed.

DETAILED DESCRIPTION OF THE PREFERRED EMBODIMENTS

Figure 1:
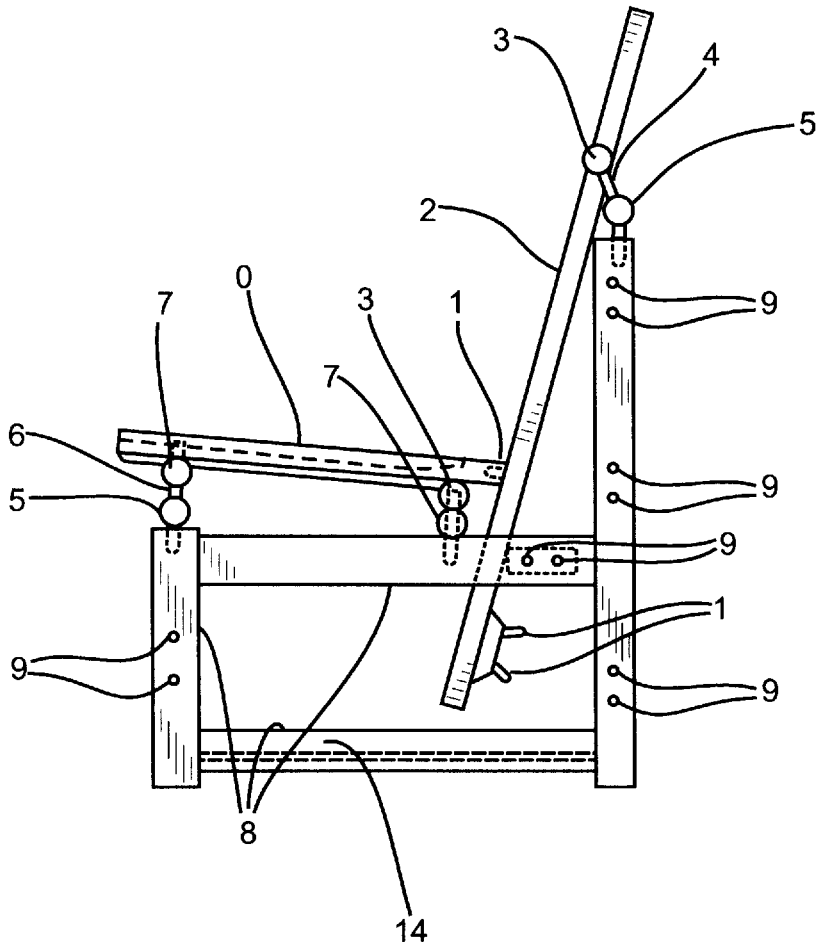
FIG. 1 is a side elevational view of the convertible chair of the present invention.
Figure 2:
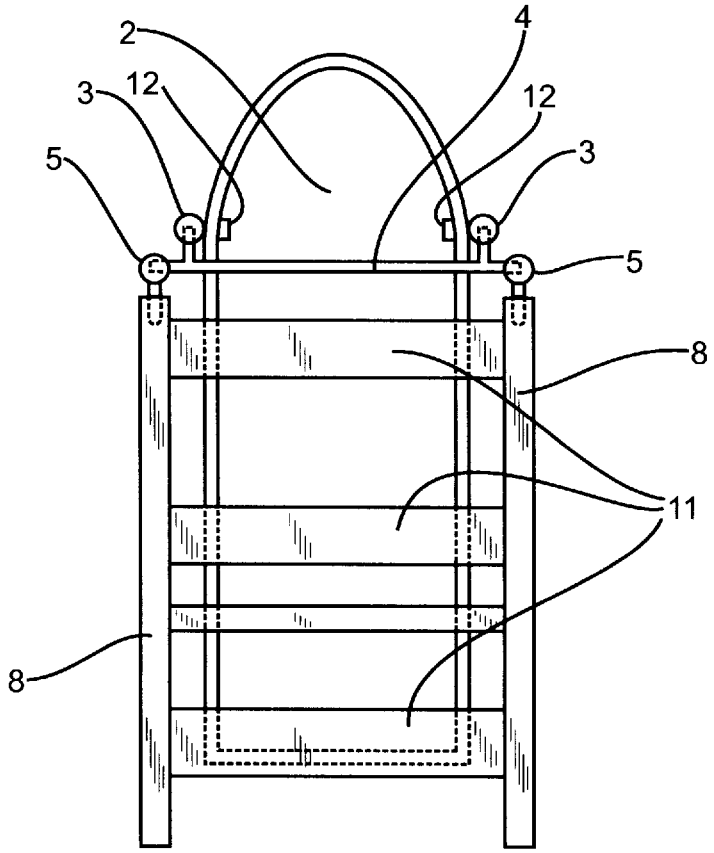
FIG. 2 is a rear elevational view of the convertible chair of FIG. 1.
Figure 4:
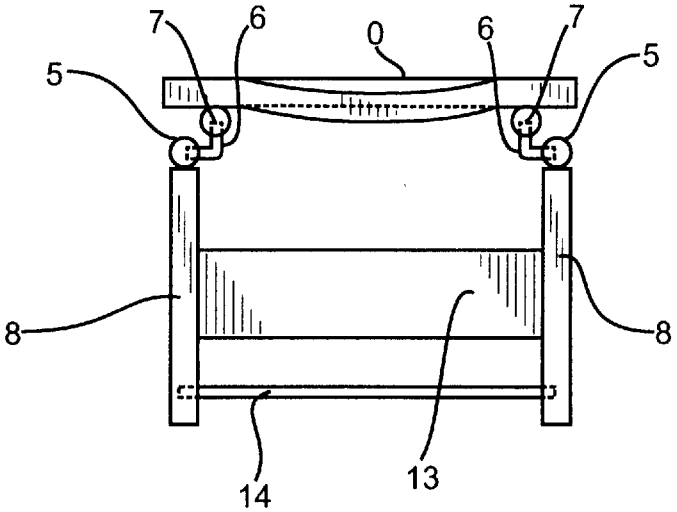
FIG. 4 is a partial front elevational view of the convertible chair of FIG. 1.
Figure 3:
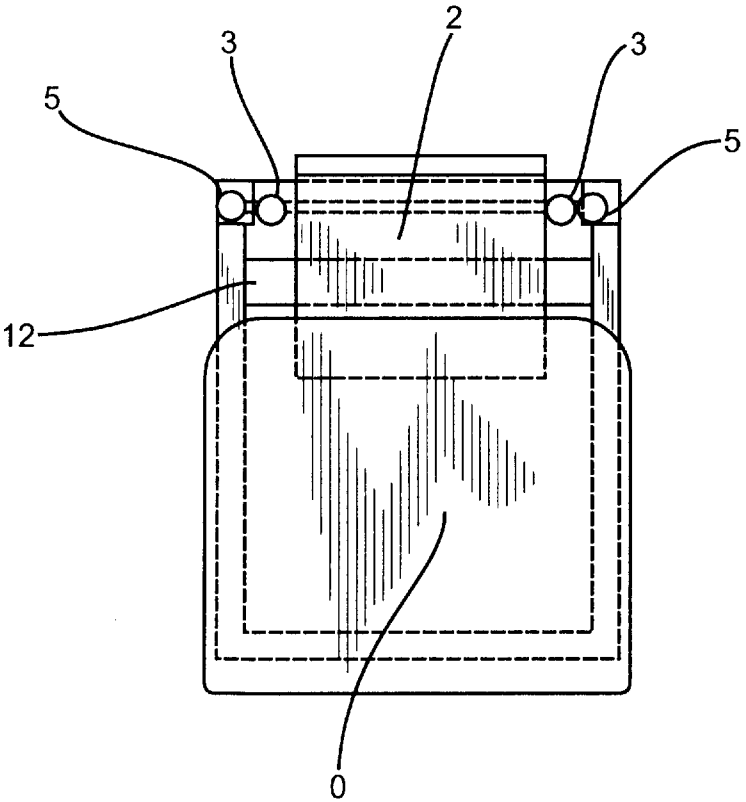
FIG. 3 is a top plan view of the convertible chair of FIG. 1.

The present invention is directed to a chair which is convertible to a table, ironing board and bar. The chair includes a pivotable panel (0) forming a seat and a pivotable board (2) forming a backrest. It is envisioned that the panel (0) will provide support for the board (2) when the latter is in the horizontal position.

Based on this concept, the frame has been coupled to the board (2), giving the frame the inside dimensions necessary for the board (2) to pass from the vertical or back-support position to the horizontal position.

Keeping in mind that the outside measurements must stay within those typical of a chair or lounge chair of these characteristics.

Thus the upper front part is deleted and the front is reinforced by making the remaining front piece, at half the height, twice as wide.

Less height is given to the sides.

A little more depth is given to the frame.

Panel (0), these panels will occasionally take a space in the upper area. Seen in the seat position, two pivotable and displaceable parts are built into front part, lower part, one on each side.

These pivoting and displaceable pieces have a radius of at least (60 mm) from the panel (0) to the pin, making the panel (0) higher than the sides, and imparting to it the conventional height for a seat.

Also when it pivots to take the vertical or board (2) support position, it is displaced toward the front of the frame, which allows the board (2) to move to its exit through the front so that it can rise to assume the horizontal position of an ironing board.

Part (6) is made with 12-mm round stock in the form of an L whose vertical surface ends on an 8-mm threaded dowel, on its horizontal surface on the end it has a 20×8 mm pin.

Part (5) is a 35-mm ball which acts as a bearing; a 40×8 mm peg protrudes from the bottom surface, perpendicular to the hole.

Part (7) is a ball with a through-hole, half with a diameter of 12 mm and the other half 9 mm, forming a complement to the design.

Part (3), a ball with a 20 mm×9 mm hole, serves as a nut.

In order to install the panel (0) into the frame, parts (6) are mounted using their threaded dowels, with the balls (7) already built in, over the holes previously formed on the lower surface of the front, near the ends.

Parts (5) which serve as a bearing for the pins of part (6) are installed one on each side on the upper part of the front in the holes made in that part of the frame.

The parts on which panel (0) rests on its lower surface, in the seat position, are mounted on the upper side of the upper parts on the sides of the frame. These parts consist of 100 mm×12 mm round stock which carries a threaded dowel at each end.

In the lower part it has a built-in complementary ball and on its upper part a nut-ball (3) on which the panel (0) rests.

Pivot part (4), consisting of 470 mm×12 mm, round stock, terminates in a 20 mm×8 mm pin at each end.

From this round stock, with a distance between them that will be determined by the width of board (2), project two perpendicular pieces of 30×12 mm round stock, on the ends of which balls (3) are affixed such that their threaded holes are facing each other.

The bearing balls (5) are installed on the pins of part (4).

This group is installed in the upper part of the back side of the frame.

Board (2) is placed between the balls (3) using screws (12), which pass through the board (2) frame tube and are introduced into the holes in the balls (3).

Thus the board is ready to assume both positions.

Complete cases are envisioned such that either panel (0) or board (2) may assume both positions.

Figure 6:
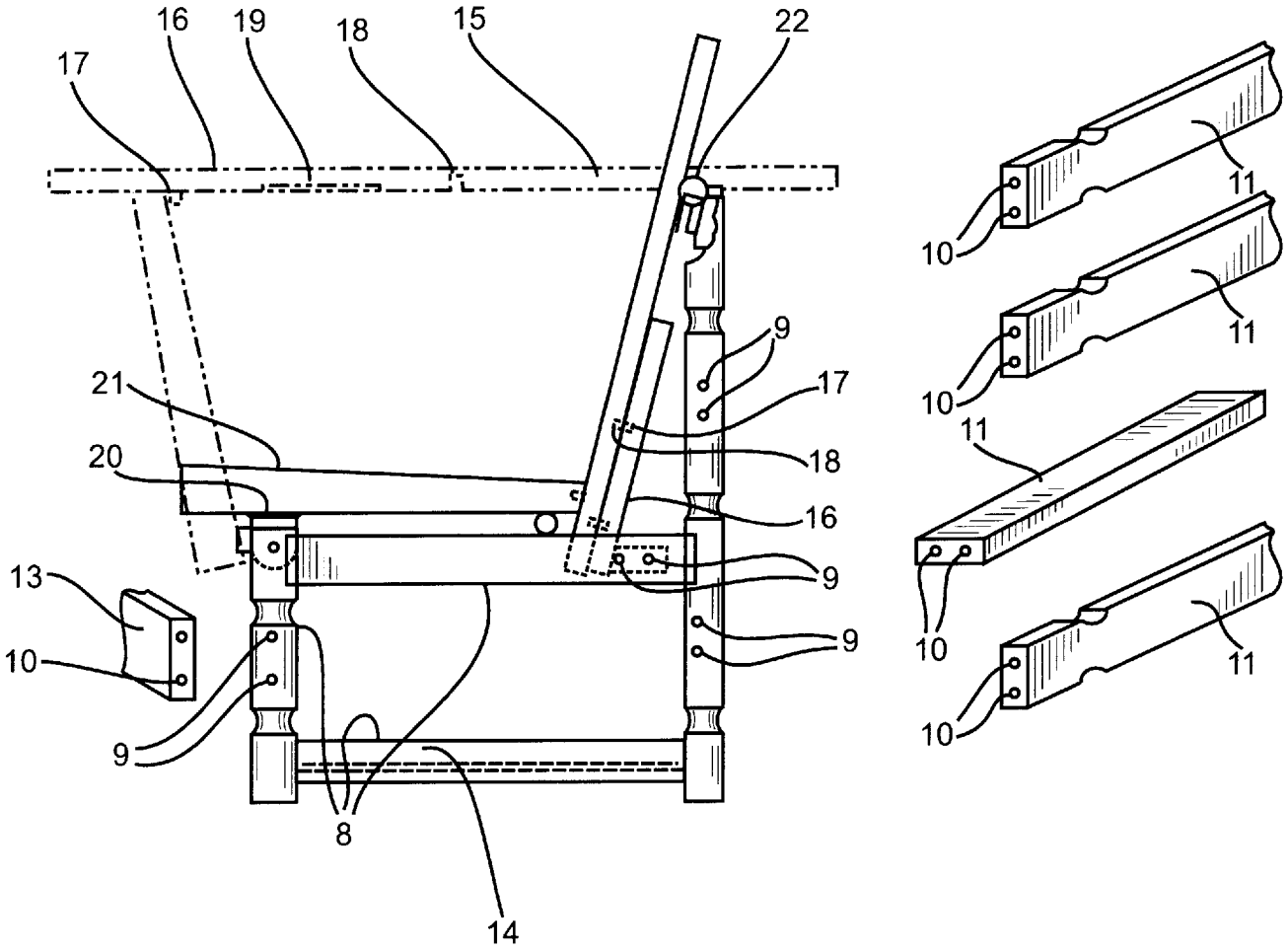
FIG. 6 is a side elevational view of an alternative embodiment of the convertible chair of the present invention.

In the bottom part, between the wooden frames (FIGS. 1 and 6), it has a built-in auxiliary panel made of 7-mm thick plywood, which is set into grooves that run the length of the insides of the lower parts of the sides of the wooden frames.

The arm rests will be made optionally. Their shape and thickness shall correspond to the design of the models on which their installation is desired. Their mounting shall employ the same method used for the frames.

The sides of the frames are prepared and mounted in the conventional manner. They have through-holes (9) which correspond to the holes (10) on assembly parts (11) and (13), which go from side to side.

These sets shall be offered unassembled in boxes.

Figure 5:
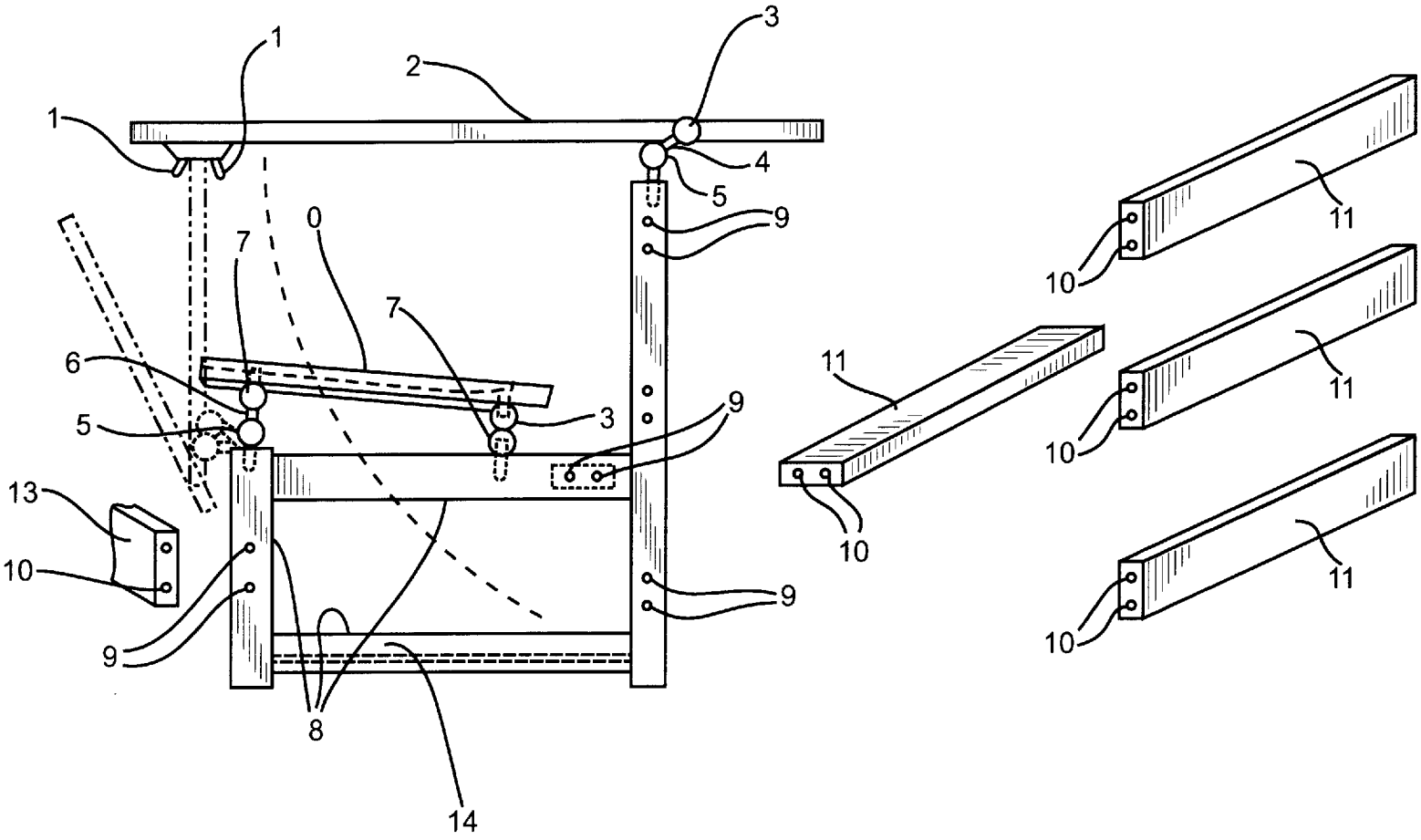
FIG. 5 is a side elevational view of the convertible chair of FIG. 1 showing the backrest in the horizontal position.

As shown in FIGS. 1 and 5, the chair may further include a part (1) which assists in removably securing the seat panel (0) to the backrest board (2) when board (2) is in the horizontal orientation.

Figure 7:
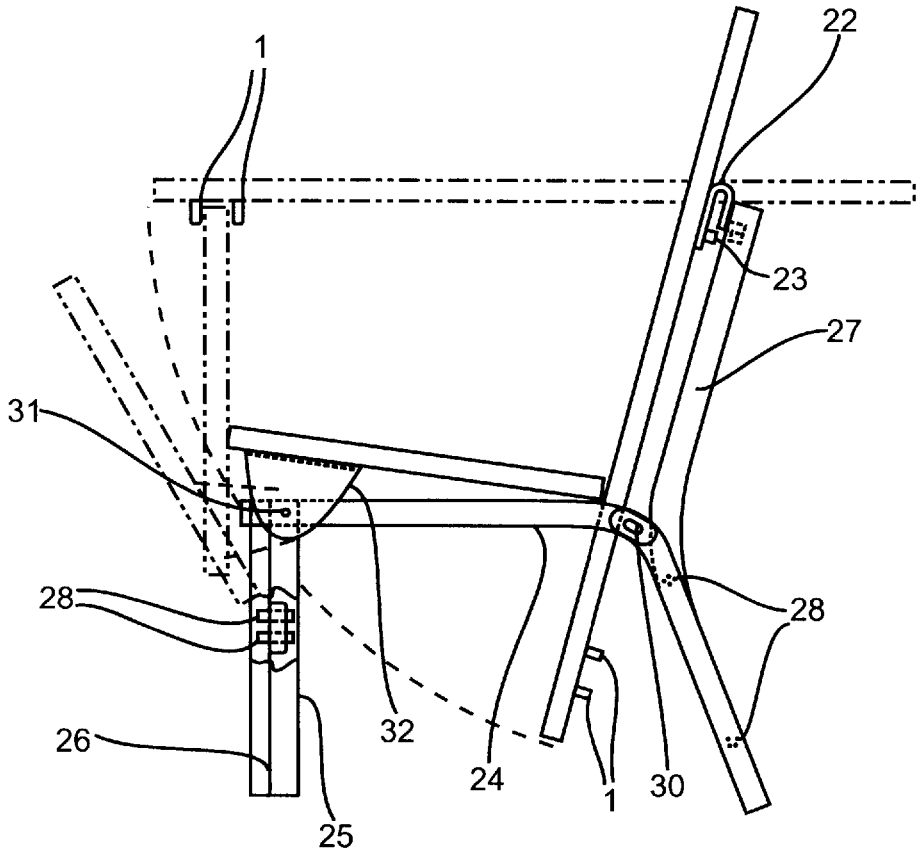
FIG. 7 is a side elevational view of an alternative embodiment of the convertible chair of the present invention.
Figure 8:
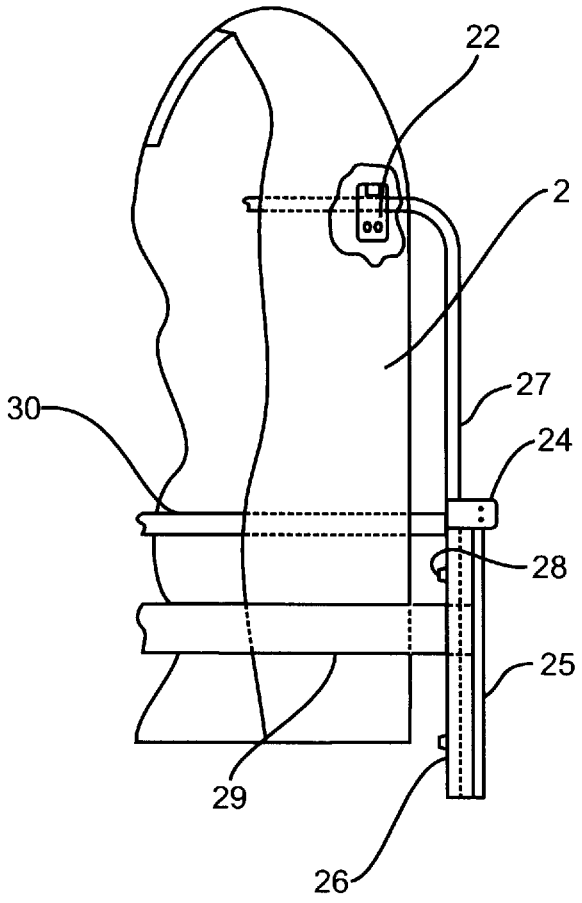
FIG. 8 is a rear elevational view of the convertible chair of FIG. 7.
Figure 10:
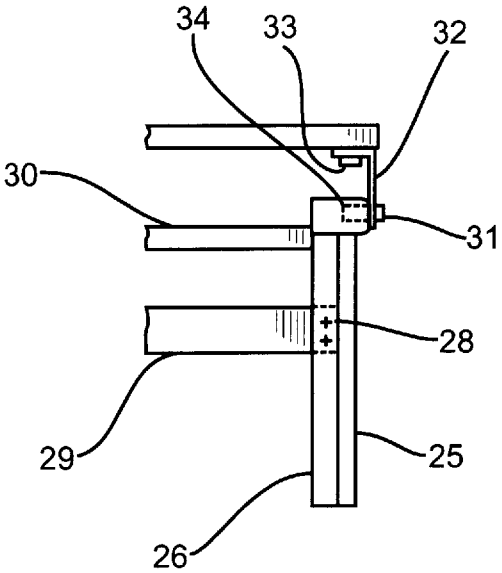
FIGS. 9–11 are detailed views of various components of the convertible chair of FIG. 7.
Figure 9:
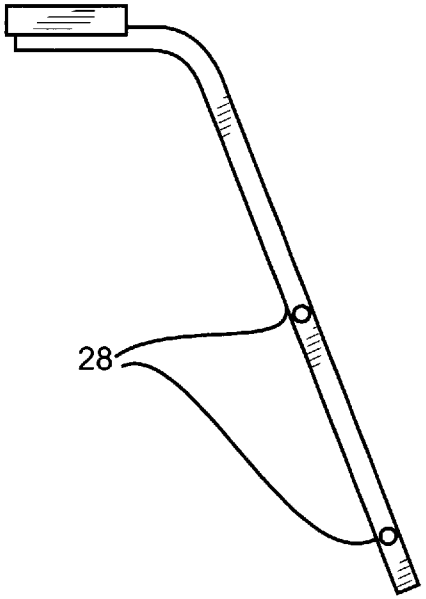

Metallic frame set (FIGS. 7 and 8) constructed from round-cornered rectangular tubing.

Formed by two inverted U-shaped sides, with the rear legs at an angle greater than 120°.

The rear part also an inverted U shape, almost twice as high as the sides. Seen from the side, it takes on an angle of over 135°.

The sides are fastened to the rear frame and to the double front piece by means of screws (28).

The nuts are installed on the inside, within the tubes that make up the sides of these frames. The heads of the screws face the inside of the frame.

The set is composed of a chair or lounge chair with an ironing board (2) that serves as a back support and as an ironing board.

The pivoting and displacement of the seat to the front in this metal frame model is performed by part (32).

This piece, mounted on either side of the frame, seen in a side elevation, has the shape of a triangle with a rounded lower vertex. There is a hole (31) over which the collar screw, which at the same time serves as the pin on which part (32) turns, is installed, and penetrates to the inside of the side where it is fastened to the frame by a nut (34) welded inside the tube.

This part (32), seen in a front elevation, has the shape of an inverted L on whose upper branch panel (0) is installed, using through-bolts.

The chair or lounge chair set is convertible into a table and bar (FIGS. 15, 16, 17, and 18), consisting of a frame, preferably of wood, on which a panel (35) has been installed, which in the horizontal position serves as a seat and in the vertical position as a support for the board (36); when the latter functions as a table, board (36) serves as back support and table.

Part (38), made with sectioned 40×2 mm sheet metal strips, similar to a U-shaped channel whose sides, on the top, open at a 25° angle, and with four pins or claws, two on each end at the bottom. The sides of the upper part are folded and extended outward in the form of a wing, bearing two holes on each wing.

These parts are assembled on the bottom side of the board, one on each side, at some 15 cm from its front end in the table position.

The height of the table, the bottom of the seat, and the inclination of the back rest are achieved by the height of these parts.

When the board (36), whose approximate measurements are length 950 mm, width 400 mm and thickness 15 mm, is vertical and in the back rest position, its lower end almost reaches the floor, set between the two bar boxes (44) that are inside the body of the seat.

The aforementioned box has, over half of its space, the rear over a quarter part, leaving a space between them, where board (36) is stored when it assumes the vertical or back support position.

In these boxes, the outer layer is made of a plastic sheet or similar material of an adequate hardness and thickness.

Along the inside corners there is 90° angle groove which allows it to be bent at the same angle.

The joining of the ends is achieved by mounting one end on top of the other. Both are screwed together to the inside of the front and rear vertical parts, which may be taken apart.

These boxes are good for storing beverage bottles, glasses, a cocktail shaker and as a bar.

Halfway up the rear vertical parts, on the inside, there are some U-shaped grooves for mounting a shelf (42) with our without railing.

In order to be able to use these spaces on the inside of the body of the seat, parts (40) have been prepared, which allow the board, part (36), which serves as back support and table, to be displaced and rise and fall from the vertical position or back support to the horizontal position or table and vice versa.

Board-support frame, part (40), seen in a top view, is a square formed by an iron bar of appropriate thickness and quality. Two pivot pieces (39) are installed on this frame in the top, and two pivot pieces (39) are installed in the bottom.

These parts are assembled on the bar before it is bent, so that once bent, it may be welded at the bottom.

Pivot pieces (39) are a tube from whose sides a wing with three holes emerges.

Board-support frame (40) is incorporated into the frame, fastened to the back, top, and front of the frame using pivot parts (39), which are screwed to the top of the frame.

Board (36) is incorporated into frame (40) by fastening pivot parts (39), which are incorporated into the bottom of frame (40), to the back of the board using screws.

For easier raising of panel (36) from the back rest position to the table position or vice versa, a handle (37) is installed through the back at over 350 mm from its top end, as seen in cross section.

Panel (36) shall have an optional S-shaped cutout near one of its corners, on one of the ends. This cutout begins at the center of one end and extends until it rounds the corner. Or two cutouts, one on each side of a corner, leaving the rounded end similar to a journal are used.

It will have ready-made holes at the back of the panel, so that when the panel is assembled, it remains at the top, either end equally being in back support position.

Figure 20:
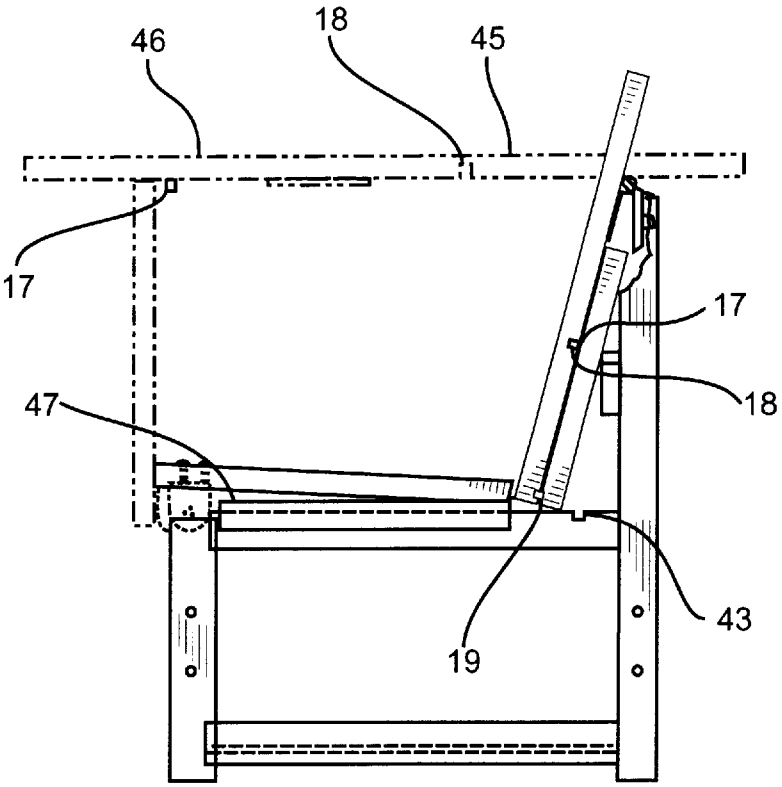
FIG. 20 is a side elevational view of an alternative embodiment of the convertible chair of the present invention.
Figure 19:
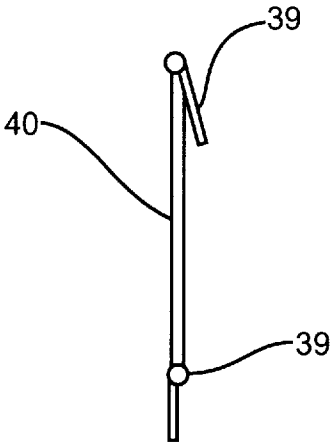
FIG. 19 is a side elevational view of the support member of FIG. 17.

FIG. 20—Convertible chair or lounge-chair set, consisting of a frame which has a flat panel which in the horizontal position serves as a seat and in the vertical position serves as a support for the board when the latter assumes the table position.

The board which serves as a table and back support in this set is composed of two boards whose measurements are over 600×400×15 mm for the front piece (45) and 350×400×15 mm for the back piece (46).

These two boards are joined by a single hinge 19 along the entire width, or by two or more hinges placed on the bottom side, when the board is seen in the horizontal or table position. When displaced from the table position to assume the back support position, the boards, when they reach the latter position, are fastened with the introduction of the screw eyes (17) through the hasps incorporated in the points (18).

This set includes a bar inside the body of the seat. It forms a box, with or without decoration, divided by boards for keeping bottles, glasses, and a cocktail shaker.

The box and the boards with the frame are removable.

Figure 21:
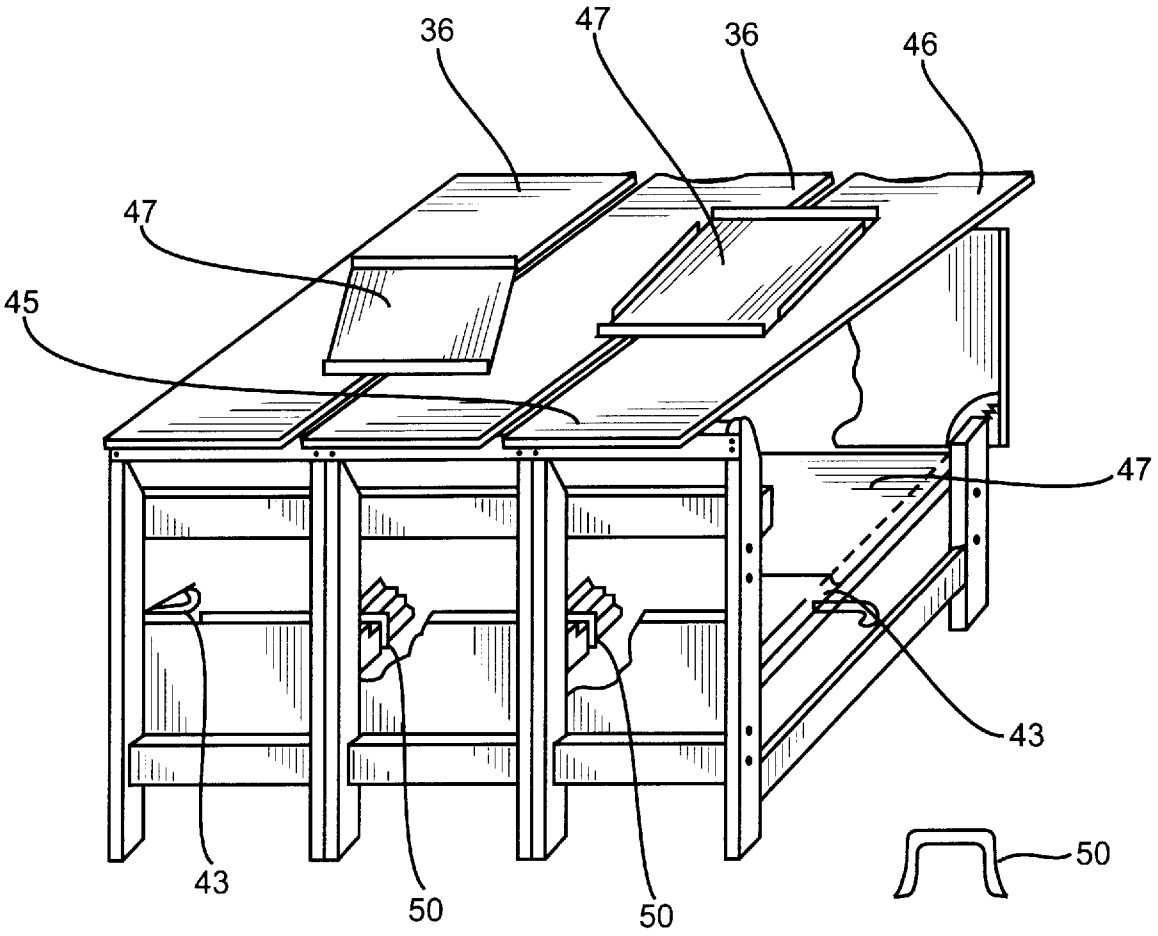
FIG. 21 is a perspective view of adjacently disposed convertible chairs attached to each other.

Part as shown in FIG. 21, several convertible chair sets may be joined by a connector (50) set into grooves (43) provided in the top of the upper sides, near rear vertical frame parts (50) made of the iron bar has an inverted U-shape with the ends slightly bent out and whose inside measurements shall be determined by the separation between the sides of the two joined sets.

What is claimed is:

1. A convertible chair comprising:

a chair frame including;

a pair of spaced front legs having an upper portion;

a pair of spaced rear legs opposed from said front legs;

a pair of upwardly extending members each having a distal end projecting from said pair of rear legs; and a plurality of connecting members rigidly securing said pair of front and rear legs to said chair;

a backrest being pivotally securable to said frame between said upwardly extending members, said backrest being rotatable from a generally vertical orientation to a substantially horizontal orientation forming a table surface;

a panel forming a seat having a front end, and having a substantially horizontal orientation forming a sitting sutface; and at least one first pivot device, said seat being pivotally securable to said frame adjacent said pair of front legs by said at least one first pivot device, said at least one first pivot device including a rigid L-shaped member having first leg and a second leg, said first leg being rotatably secured to said frame about a first center of rotation and said second leg spacing said seat a distance from said frame and being rigidly attached to a bottom surface of said seat, said seat being rotatable to a substantially vertical orientation and selectively engageable with said horizontally orientated backrest, thereby forming a support for said backrest in said horizontal orientation.

2. A convertible chair as defined in claim 1, wherein said seat front end is pivotally secured to said upper portion of said pair of front legs.

3. A convertible chair as defined in claim 1 wherein said backrest is secured to said frame by an at least one second pivot device, said second pivot device including a first portion pivotally secured to an upper portion of one of said extending members about a second center of rotation, said second pivot device further including a second portion pivotally secured to said backrest about a third center of rotation offset from said second center of rotation, such that said backrest is rotated upwardly and rearwardly away from said seat so that said backrest is not restricted by said seat upon rotation of said backrest to said horizontal orientation.

4. A convertible chair as defined in claim 3 wherein said backrest is restricted from radial translation with respect to said third center of rotation, such that said backrest may not slide with respect thereto upon rotation from said vertical to said horizontal orientation.

5. A convertible chair as defined in claim 1 further including a pair of said first pivot devices and wherein said seat is pivotally secured to said pair of said front legs by said pair of first pivot devices.

6. A convertible chair as defined in claim 1, further comprising a pair of spaced containers removably secured within said frame below said seat when said seat is in said horizontal orientation.

7. A convertible chair as defined in claim 1, wherein said backrest includes a first and second board, said first board being pivotally secured to said second board, said first board having a first position being folded against said second board when said backrest is in said generally vertical orientation, said first board having a second position extending outwardly from said backrest second board when said backrest is in said substantially horizontal orientation.

8. A convertible chair comprising:

a chair frame including;

a pair of spaced front legs having an upper portion;

a pair of spaced rear legs opposed from said front legs;

a pair of upwardly extending members each having a distal end projecting from said pair of rear legs; and a plurality of connecting members rigidly securing said pair of front and rear legs to said chair;

a backrest having a lower end;

a backrest pivot member, pivotally securing said backrest to said frame between said upwardly extending members, said backrest being rotatable from a generally vertical orientation to a substantially horizontal orientation forming a table surface;

a panel forming a seat having a front end, said seat being pivotally securable to said frame, said seat having a substantially horizontal orientation forming a sitting surface, said seat being rotatable to a substantially vertical orientation selectively engageable with said horizontally orientated backrest, thereby forming a support for said backrest in said horizontal orientation; and a pair of spaced containers removably secured within said frame below said seat when said seat is in said horizontal orientation, and wherein said backrest lower end is insertable between said spaced containers when said backrest is in said substantially vertical orientation, and said backrest pivot member permits said backrest lower end to be selectively removed from and inserted into a space between said containers.

9. A convertible chair as defined in claim 8, wherein said back rest pivot member includes a longitudinally extending support member having a first and second end, said first end being pivotally secured adjacent to said distal ends of said upwardly extending members and said second end being pivotally secured to said backrest adjacent a midpoint thereof, said support member permitting said backrest to rotate about two independent points thereby permitting said backrest to be positioned between said spaced containers and rotated to said horizontal orientation without being restricted by said seat.

10. A convertible chair as defined in claim 8, wherein said frame further includes a pair of cross members extending between said front legs and said back legs, and a shelf for supporting said pair of containers extending between and being supported by said pair of cross members.

11. A convertible chair as defined in claim 8, wherein said seat front end is pivotally secured to said upper portion of said pair of front legs.

12. A convertible chair as defined in claim 8, further including a securement device for removably securing said seat in said vertical position to said backrest formed on an under surface of said backrest.

13. A convertible chair as defined in claim 8, wherein said seat is pivotally secured to said frame by at least one pivot device having a first portion rotatably secured to said frame and a second portion rigidly secured to said seat.

14. A convertible chair comprising:

a chair frame including;

a pair of spaced front legs having an upper portion;

a pair of spaced rear legs opposed from said front legs;

a pair of upwardly extending members each having a distal end projecting from said pair of rear legs; and a plurality of connecting members rigidly securing said pair of front and rear legs to said chair;

at least one seat pivot device;

a seat having a substantially horizontal orientation forming a sitting surface, said seat being pivotally securable to said frame adjacent said pair of front legs by said at least one seat pivot device, and said at least one seat pivot device including an off-set member having a first and second leg, said first leg being rotatably secured to said frame about a first center of rotation and said second leg spacing said seat a distance from said frame and being rigidly attached to a bottom surface of said seat:

at least one backrest pivot device;

a backrest being pivotally secured to said frame between said upwardly extending members by said at least one backrest pivot device, said at least one backrest pivot device including a first portion pivotally secured adjacent to said distal end of one of said extending members about a second center of rotation, said at least one backrest pivot device further including a second portion pivotally secured to said backrest about a third center of rotation radially offset from said second center of rotation, such that said backrest being rotatable and translatable with respect to said frame upon movement from a generally vertical orientation to a substantially horizontal orientation forming a table surface; and said seat being rotatable to a substantially vertical orientation selectively engageable with said horizontally orientated backrest, thereby forming a support for said backrest in said horizontal orientation.

15. A convertible chair comprising:

a chair frame including;

a pair of spaced front legs having an upper portion;

a pair of spaced rear legs opposed from said front legs;

a pair of upwardly extending members each having a distal end projecting from said pair of rear legs; and a plurality of connecting members rigidly securing said pair of front and rear legs to said chair, a panel forming a seat having a front end, said seat being pivotally securable to said frame, said seat having a substantially horizontal orientation forming a sitting surface;

at least one backrest pivot device, a backrest being pivotally securable to said frame between said upwardly extending members by said at least one backrest pivot device, said at least one backrest pivot device including a first portion pivotally secured adjacent to said distal end of one of said extending members about a first center of rotation, said at least one backrest pivot device further including a second portion pivotally secured to said backrest about a second center of rotation radially offset from said second center of rotation, such that said backrest is rotatable and translatable with respect to said frame upon movement from a generally vertical orientation to a substantially horizontal orientation forming a table surface; and said seat being rotatable to a substantially vertical orientation selectively engageable with said horizontally orientated backrest, thereby forming a support for said backrest in said horizontal orientation.

* * * * *

UNITED STATES PATENT AND TRADEMARK OFFICE

CERTIFICATE OF CORRECTION

PATENT NO. : 5,833,306

DATED : November 10, 1998

INVENTOR(S) : Breto et al.

It is certified that error appears in the above-identified patent and that said Letters Patent is hereby corrected as shown below:

| | |
|---|---|
| Column 1, Line 39, | delete "favorable economically", and insert therefor --favorable economically than when bought separately--. |
| Column 1, Line 57, | delete "orientation than when bought separately", and insert therefor --orientation--. |
| Column 3, Line 66, | delete "constructed from", and insert therefor --[is] constructed from--. |
| Column 6, Line 13, | delete "sutface", and insert therefor --surface--. |
| Abstract, Line 7, | delete "position, Additionally,", and insert therefor --position. Additionally,--. |

UNITED STATES PATENT AND TRADEMARK OFFICE

CERTIFICATE OF CORRECTION

PATENT NO. : 5,833,306

DATED : November 10, 1998

INVENTOR(S) : Breto et al.

Figure 12:
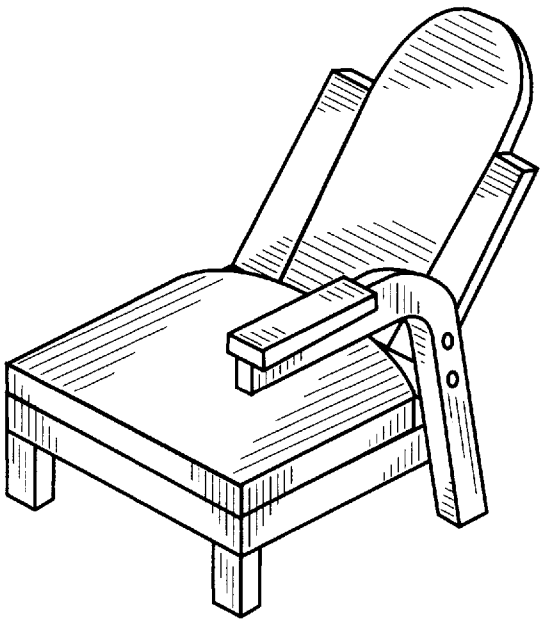
FIGS. 12–14 are various perspective views of the different configurations of the convertible chair of FIG. 7.
Figure 11:
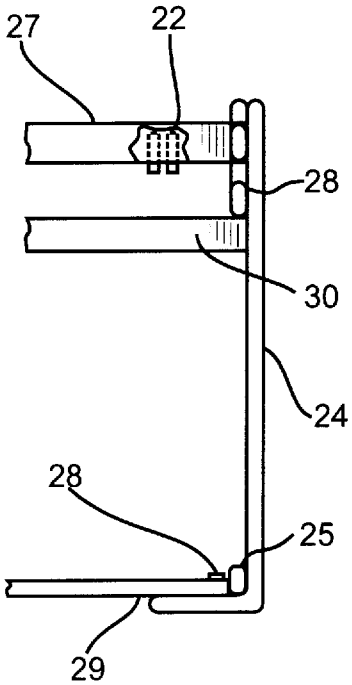
Figure 14:
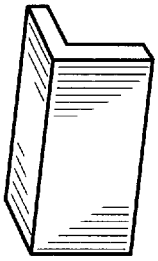
Figure 13:
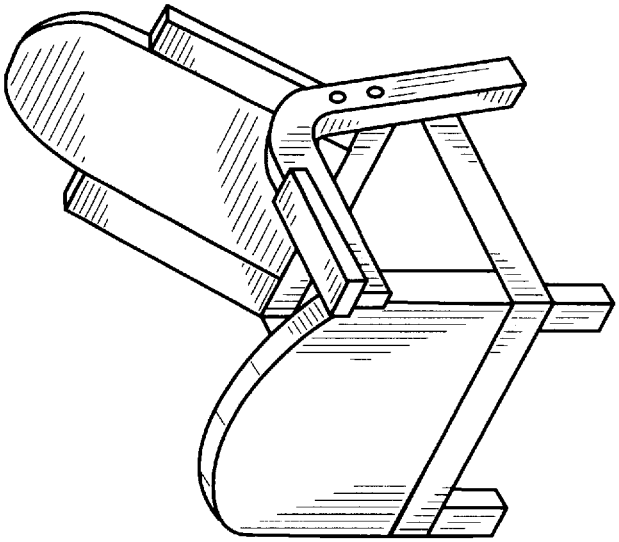
Figure 15:
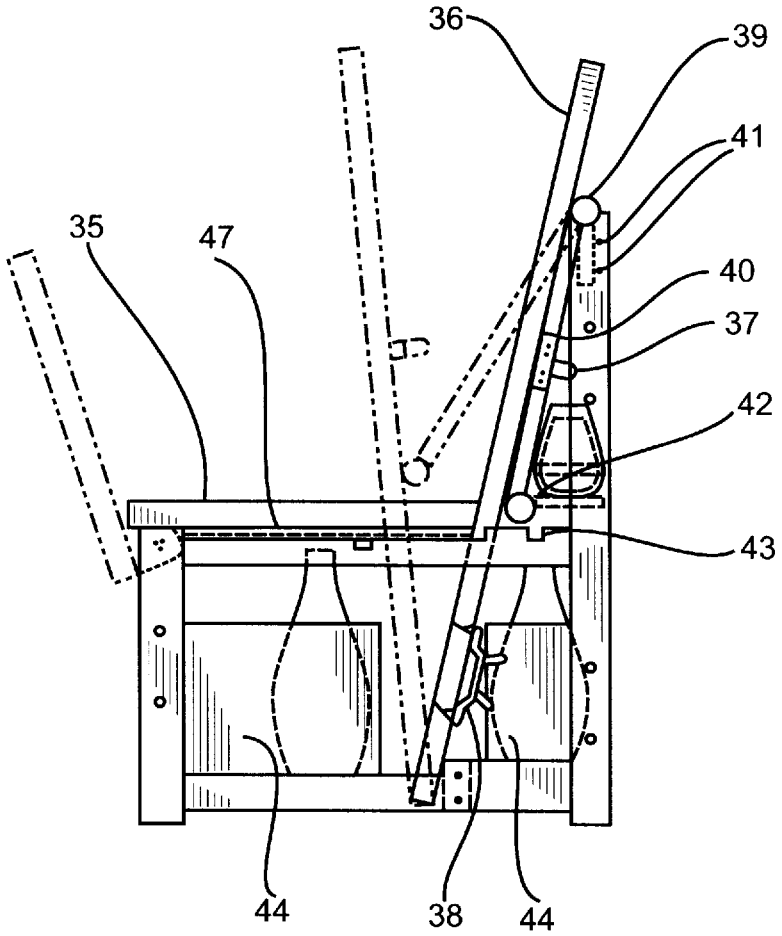
FIG. 15 is a side elevational view of an alternative embodiment of the convertible chair of the present invention.
Figure 16:
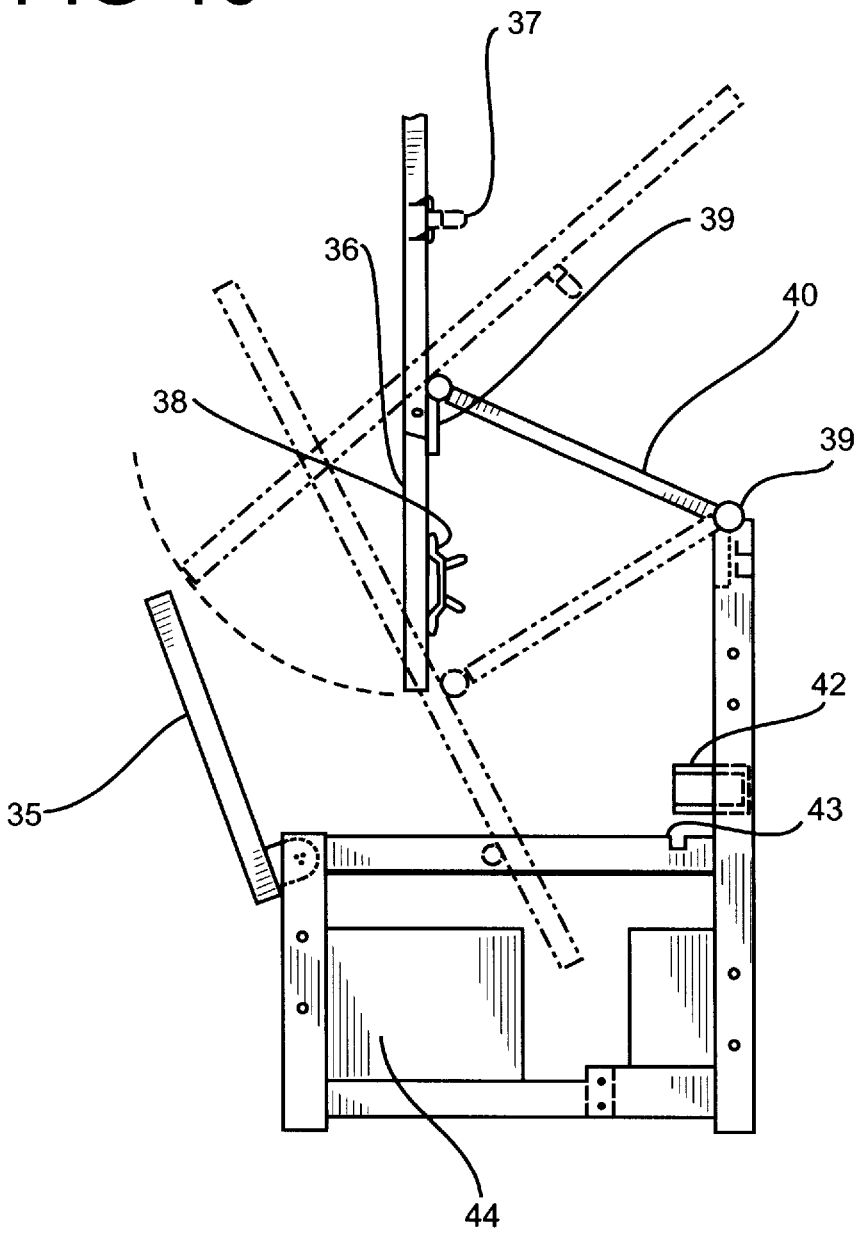
FIG. 16 is a side elevational view of the convertible chair of FIG. 15 showing the seat and showing the movement of the seat and backrest.
Figure 18:
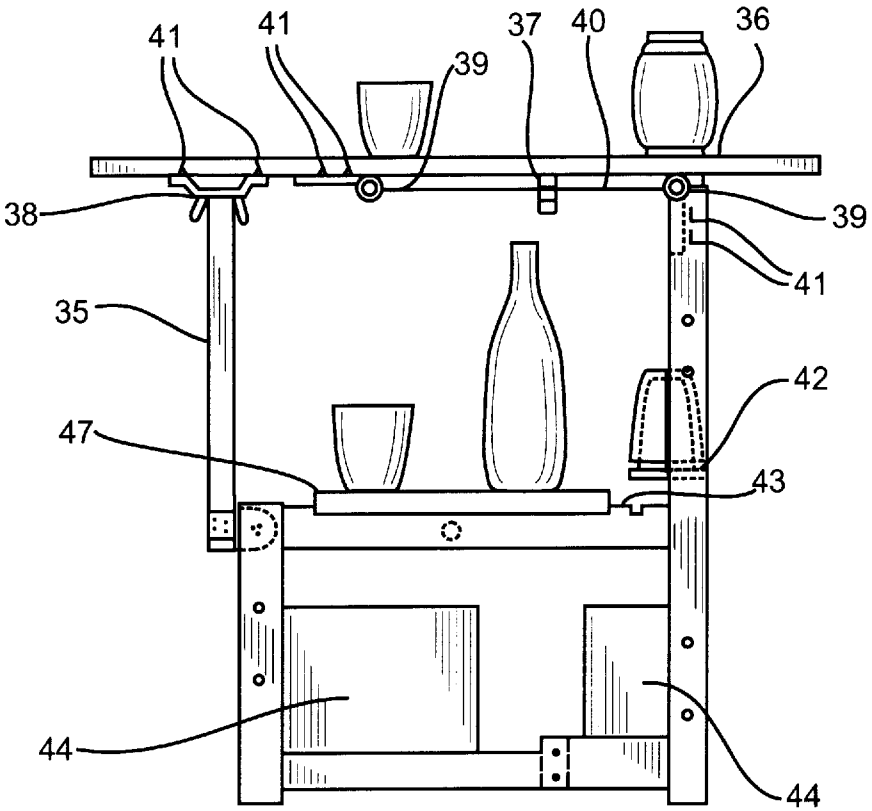
FIG. 18 is a side elevational view of the convertible chair of FIG. 15 showing the chair converted into a table and bar.
Figure 17:
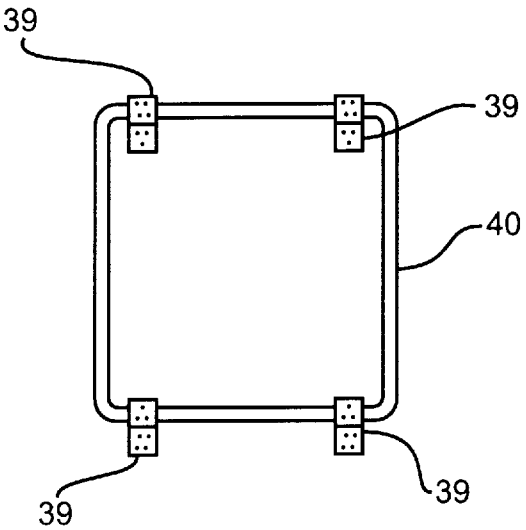
FIG. 17 is a top plan view of the support member of FIG. 15.

It is certified that error appears in the above-identified patent and that said Letters Patent is hereby corrected as shown below:

Column 2, Line 16, delete "Figures 12-14", and insert therefore --Figures 12 and 13 --.

Column 2, after Line 17, insert -- Figure 14 is a perspective view of a front part of the present invention which extends between the front legs of the chair of Figures 12 and 13. -- .

Signed and Sealed this

First Day of June, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,833,306
DATED : November 10, 1998
INVENTOR(S) : Matilde Breto

It is certified that error appears in the above-identified patent and that said Letters Patent is hereby corrected as shown below:

Title page:

U. S. PATENT DOCUMENTS

| | | | |
|---|---|---|---|
| 491,602 | 2/1893 | Schulte | 297/124 |
| 2,812,227 | 11/1957 | Hill | 297/188.1 |
| 5,282,669 | 2/1994 | Barile | 297/248 |

FOREIGN PATENT DOCUMENTS

| | | | |
|---|---|---|---|
| 431,346 | 7/1935 | Great Britain | 297/124 |
| 374,304 | 6/1932 | Great Britain | 297/124 |
| 17,146 | 7/1907 | Great Britain | 297/125 |
| 14,594 | 10/1887 | Great Britain | 297/125 |
| 1,429,265 | 1/1969 | Germany | 297/124 |

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*